US012392538B2

(12) United States Patent
Lim et al.

(10) Patent No.: US 12,392,538 B2
(45) Date of Patent: Aug. 19, 2025

(54) REFRIGERATOR INCLUDING A DEEP FREEZING UNIT

(71) Applicant: LG ELECTRONICS INC., Seoul (KR)

(72) Inventors: Hyoungkeun Lim, Seoul (KR); Seokjun Yun, Seoul (KR); Seongmin Song, Seoul (KR); Junghun Lee, Seoul (KR); Hoyoun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 752 days.

(21) Appl. No.: 17/433,429

(22) PCT Filed: Feb. 13, 2020

(86) PCT No.: PCT/KR2020/002067

§ 371 (c)(1),
(2) Date: Aug. 24, 2021

(87) PCT Pub. No.: WO2020/175821

PCT Pub. Date: Sep. 3, 2020

(65) Prior Publication Data

US 2022/0146155 A1 May 12, 2022

(30) Foreign Application Priority Data

Feb. 28, 2019 (KR) ..... 10-2019-0023894

(51) Int. Cl.

| | |
|---|---|
| ***F25B 21/02*** | (2006.01) |
| ***F25D 11/02*** | (2006.01) |
| ***F25D 13/04*** | (2006.01) |
| ***F25D 17/06*** | (2006.01) |

(Continued)

(52) U.S. Cl.
CPC ..... *F25D 13/04* (2013.01); *F25B 21/02* (2013.01); *F25D 11/02* (2013.01); *F25D 17/065* (2013.01);

(Continued)

(58) Field of Classification Search
CPC ..... F25B 21/02; F25B 2321/02; F25B 2321/023; F25D 11/025; F25D 13/04;

(Continued)

(56) References Cited

U.S. PATENT DOCUMENTS

2006/0218937 A1* 10/2006 Park ..... F25B 21/02 62/3.6
2007/0284985 A1* 12/2007 Wing ..... F25D 25/024 312/408

(Continued)

FOREIGN PATENT DOCUMENTS

CN 106679269 A 5/2017
JP H0250054 A * 2/1990 ..... F25D 11/00

(Continued)

*Primary Examiner* — Jerry-Daryl Fletcher
*Assistant Examiner* — Daniel C Comings
(74) *Attorney, Agent, or Firm* — Bryan Cave Leighton Paisner LLP

(57) ABSTRACT

A refrigerator includes a refrigerating compartment, a freezing compartment partitioned from the refrigerating compartment, a freezing unit mounted at one side of an inside of the freezing compartment, and the freezing unit including a cooling case defining a cooling compartment partitioned from the freezing compartment and a cooling drawer insertable into the cooling compartment. A guide duct is mounted on a ceiling of the cooling case and communicates with a grille, and the guide duct includes a bottom portion having a plurality of cold air discharge holes, where at least a portion of the bottom portion is spaced apart from the top portion at a lower side of the top portion to define a passage for guiding the cold air into the cooling compartment.

16 Claims, 5 Drawing Sheets

(51) Int. Cl.
*F25D 17/08* (2006.01)
*F25D 23/06* (2006.01)

(52) U.S. Cl.
CPC ..... *F25D 17/08* (2013.01); *F25D 23/069* (2013.01); *F25D 2317/0665* (2013.01)

(58) Field of Classification Search
CPC ..... F25D 17/065; F25D 17/08; F25D 23/061; F25D 23/069; F25D 2317/06; F25D 2317/063; F35D 25/55
See application file for complete search history.

(56) References Cited

U.S. PATENT DOCUMENTS

2009/0288441 A1* 11/2009 Fotiadis ..... F25D 17/065 62/407
2012/0312030 A1* 12/2012 Lu ..... F25B 21/02 62/3.2
2013/0276465 A1* 10/2013 Shin ..... F25D 25/025 62/3.6
2015/0192344 A1* 7/2015 Lim ..... F25B 5/02 62/441
2018/0347871 A1 12/2018 Park et al.

FOREIGN PATENT DOCUMENTS

| | | | | |
|---|---|---|---|---|
| JP | 9-257355 | A | 10/1997 | |
| JP | 2002-228332 | A | 8/2002 | |
| KR | 1997-0066440 | A | 10/1997 | |
| KR | 20-0152099 | Y1 | 7/1999 | |
| KR | 10-0872856 | B1 | 12/2008 | |
| KR | 20170124246 | A | 11/2017 | |
| KR | 10-2018-0080652 | A | 7/2018 | |
| KR | 10-2018-0131752 | A | 12/2018 | |
| WO | WO-2019190006 | A1 * | 10/2019 | ..... F25C 1/24 |

* cited by examiner

REFRIGERATOR INCLUDING A DEEP FREEZING UNIT

This application is the National Stage filing under 35 U.S.C. 371 of International Application No. PCT/KR2020/002067, filed on Feb. 13, 2020, which claims the benefit of Korean Patent Application No. 10-2019-0023894, filed on Feb. 28, 2019, the contents of which are all hereby incorporated by reference herein in their entirety.

TECHNICAL FIELD

The present invention relates to a refrigerator.

BACKGROUND ART

In general, a refrigerator is a home appliance for storing food at a low temperature, and includes a refrigerating compartment for storing food in a refrigerated state in a range of 3° C. and a freezing compartment for storing food in a frozen state in a range of −20° C.

However, when food such as meat or seafood is stored in the frozen state in the existing freezing compartment, moisture in cells of the meat or seafood are escaped out of the cells in the process of freezing the food at the temperature of −20° C., and thus, the cells are destroyed, and taste of the food is changed during an unfreezing process.

However, destruction of cells may be minimized by setting a temperature condition of the storage compartment to a cryogenic state that is significantly lower than a temperature of the current freezing compartment so that food quickly passes through a freezing point temperature range when the food is changed to a frozen state. As a result, even after thawing, there is an advantage that meat quality and texture return to a state that is close to a state before freezing. The cryogenic temperature may be understood to mean a temperature in a range of −45° C. to −50° C.

For this reason, in recent years, the demand for a refrigerator equipped with a deep freezing compartment that is maintained at a temperature lower than a temperature of the freezing compartment is increasing.

Also, FIG. 2 is a perspective view of the refrigerator door according to an embodiment. In order to satisfy the demand for the deep freezing compartment, there is a limit to the cooling using an existing refrigerant. Thus, an attempt is made to lower the temperature of the deep freezing compartment to a cryogenic temperature by using a thermoelectric module (TEM).

In the prior art below, a deep freezing compartment is provided in a freezing compartment, and a thermoelectric module is employed so as to maintain the deep freezing compartment temperature at a cryogenic temperature that is significantly lower than the freezing compartment temperature.

Particularly, the contents are disclosed that an evaporator through which a refrigerant flows is employed as a heat dissipation means attached to a heat generation surface of the thermoelectric module.

Referring to FIG. 18 of Korean Patent Publication No. 2018-0131752 (Dec. 11, 2018), which is a prior art, a blower type cooling fan is applied to allow cold air in a deep freezing compartment to forcibly flow.

That is, the cold air is blown from the cooling fan so that the cold air flows into a drawer through a rear surface of the drawer, and the cold air inside the drawer flows to a rear side of the deep freezing compartment and then is suctioned into a cooling device of the thermoelectric module through a suction portion provided at each of upper and lower sides of the deep freezing temperature storage compartment.

In the case of such a cold air circulation structure, when a lot of food is loaded at a rear side of the drawer, or a box-shaped object is stored at the rear side of the drawer, there is a problem in that circulation of cold air in the deep freezing compartment is not smoothly performed due to flow resistance.

Particularly, when a rear surface of the drawer is blocked by the food or storage items, the cold air discharged from the cooling fan does not flow into the drawer, and am amount of cold air returning to the suction portion is reduced. As a result, a discharge-side pressure in front of the cooling fan is high, and a suction-side pressure behind the cooling fan is low. Thus, there is a problem in that a load of the cooling fan excessively increases, and power consumption increases.

Above all, temperature distribution in the deep freezing compartment is not uniformly maintained, and a temperature at a rear side of the deep freezing compartment may be very low, but a temperature at a front side of the deep freezing compartment may be high.

DISCLOSURE OF THE INVENTION

Technical Problem

The present invention has been proposed to improve the above-described limitations.

Technical Solution

A refrigerator according to an embodiment of the present invention for achieving the above object includes: a refrigerating compartment; a freezing compartment partitioned from the refrigerating compartment; a deep freezing unit mounted at one side of an inside of the freezing compartment, the deep freezing unit comprising a deep freezing case configured to define a deep freezing compartment partitioned from the freezing compartment and a deep freezing drawer inserted into the deep freezing compartment; and a freezing evaporation compartment defined behind the deep freezing case.

In addition, a refrigerator according to an embodiment of the present invention includes: a partition wall; a freezing compartment evaporator accommodated in the freezing evaporation compartment to generate the cold air for cooling the freezing compartment; a freezing compartment fan driven to supply the cold air in the freezing evaporation compartment to the freezing compartment; a thermoelectric module configured to provide a temperature of the deep freezing compartment to a temperature lower than that of the freezing compartment; and a deep freezing compartment fan configured to allow air within the deep freezing compartment to forcibly flow.

The partition wall may include a deep freezing compartment-side discharge grille configured to discharge cold air into the deep freezing compartment and a freezing compartment-side discharge grille configured to discharge the cold air into the freezing compartment.

The thermoelectric module may include: a thermoelectric element having a heat absorption surface facing the deep freezing compartment and a heat generation surface defined as an opposite surface of the heat absorption surface; a cold sink that is in contact with the heat absorption surface and disposed behind the deep freezing compartment; and a heat sink that is in contact with the heat generation surface and defined as a deep freezing evaporator connected in series to the freezing compartment evaporator.

In addition, a refrigerator according to another embodiment of the present invention may further include a guide duct mounted on a ceiling of the deep freezing case to communicate with the deep freezing compartment-side discharge grille.

Advantageous Effects

The refrigerator according to embodiment of the present invention may have the following effects.

First, since the suction type cooling fan is applied, even if the amount of food or things stored in the deep freezing storage compartment is large, the flow resistance may be reduced when compared to the case in which the blower type cooling fan is applied.

Second, since the guide duct is mounted to smoothly supply the cool air forward from the rear side of the deep freezing compartment, the cold air cooled while passing through the cold sink of the thermoelectric module may be guided to the front of the deep freezing compartment without the flow resistance.

Third, regardless of the amount of food stored in the deep freezing compartment, the cold air cooled by the thermoelectric module may be guided to the front region of the deep freezing compartment, and thus, the temperature distribution inside the deep freezing compartment may be maintained uniformly.

Fourth, since the area of the cold air discharge hole formed in the guide duct gradually increases from the rear side to the front side of the deep freezing compartment, the amount of cold air discharged to the front side of the deep freezing compartment and the amount of cold air discharged to the intermediate point of the deep freezing compartment may be uniformly maintained.

In other words, there may be the advantage in that the decrease in amount of the discharged cold air as it moves away from the cooling fan is capable of being minimized.

MODE FOR CARRYING OUT THE INVENTION

Hereinafter, a refrigerator according to an embodiment of the present invention will be described in detail with reference to the accompanying drawings.

Figure 1:
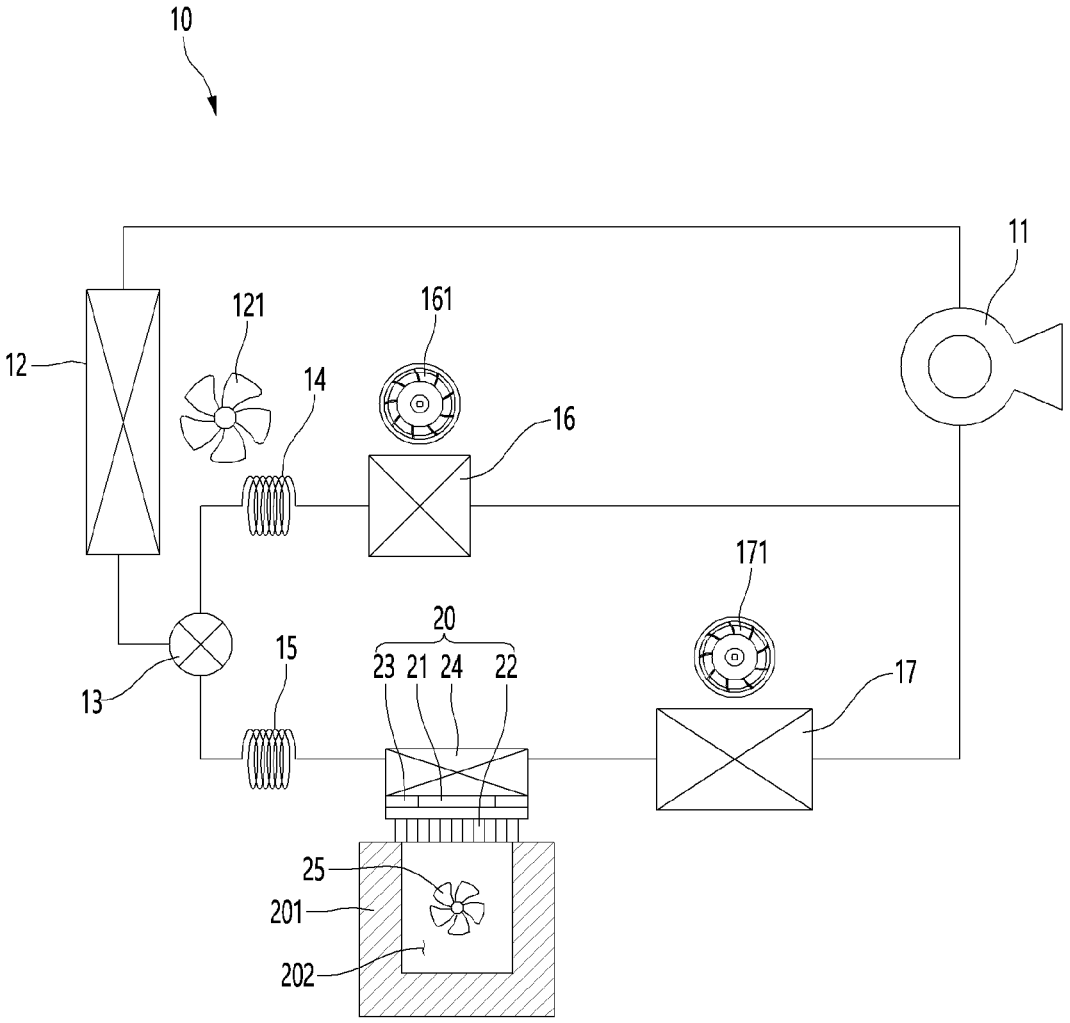
FIG. 1 is a view illustrating a refrigerant circulation system of a refrigerator according to an embodiment of the present invention.

FIG. 1 is a view illustrating a refrigerant circulation system of a refrigerator according to an embodiment of the present invention.

Referring to FIG. 1, a refrigerant circulation system according to an embodiment of the present invention includes a compressor 11 that compresses a refrigerant into a high-temperature and high-pressure gaseous refrigerant, a condenser 12 that condenses the refrigerant discharged from the compressor 11 into a high-temperature and high-pressure liquid refrigerant, an expansion valve that expands the refrigerant discharged from the condenser 12 into a low-temperature and low-pressure two-phase refrigerant, and an evaporator that evaporates the refrigerant passing through the expansion valve into a low-temperature and low-pressure gaseous refrigerant. The refrigerant discharged from the evaporator flows into the compressor 11. Also, the components constituting the refrigerant circulation system are connected to each other by a refrigerant pipe to constitute a closed circuit.

Figure 2:
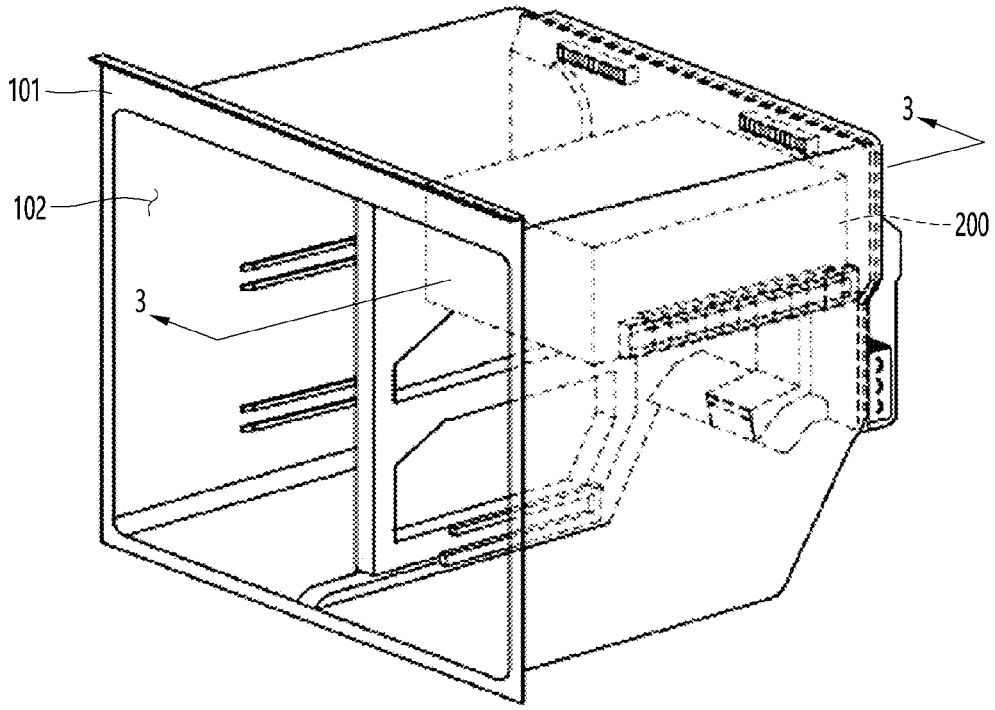
FIG. 2 is a perspective view illustrating structures of a freezing compartment and a deep freezing compartment of the refrigerator according to an embodiment of the present invention.

In detail, the expansion valve may include a refrigerator compartment expansion valve 14 and a freezing compartment expansion valve 15. Also, FIG. 2 is a perspective view of the refrigerator door according to an embodiment. The refrigerant pipe is divided into two branches at an outlet side of the condenser 12, and the refrigerating compartment expansion valve 14 and the freezing compartment expansion valve 15 are respectively connected to the refrigerant pipe that is divided into the two branches. That is, the refrigerating compartment expansion valve 14 and the freezing compartment expansion valve 15 are connected in parallel at the outlet of the condenser 12.

Also, a switching valve 13 is mounted at a point at which the refrigerant pipe is divided into the two branches at the outlet side of the condenser 12. The refrigerant passing through the condenser 12 may flow through only one of the refrigerating compartment expansion valve 14 and the freezing compartment expansion valve 15 by an operation of adjusting an opening degree of the switching valve 13 or may flow to be divided into both sides.

The switching valve 13 may be a three-way valve, and a flow direction of the refrigerant is determined according to an operation mode. Here, one switching valve such as the three-way valve may be mounted at an outlet of the condenser to control the flow direction of the refrigerant, or alternatively, the switching valves are mounted at inlet sides of a refrigerator compartment expansion valve 14 and a freezing compartment expansion valve 15, respectively.

The evaporator may include a refrigerating compartment evaporator 16 connected to an outlet side of the refrigerating compartment expansion valve 14 and a deep freezing compartment evaporator 24 and a freezing compartment evaporator 17, which are connected in series to an outlet side of the freezing compartment expansion valve 15. The deep freezing compartment evaporator 24 and the freezing compartment evaporator 17 are connected in series, and the refrigerant passing through the freezing compartment expansion valve passes through the deep freezing compartment evaporator 24 and then flows into the freezing compartment evaporator 17.

Here, the deep freezing compartment evaporator 24 may be disposed at an outlet side of the freezing compartment evaporator 17 so that the refrigerant passing through the freezing compartment evaporator 17 flows into the deep freezing compartment evaporator 24.

Also, it should be noted that the structure in which the deep freezing compartment evaporator 24 and the freezing compartment evaporator 17 are connected in parallel at an outlet end of the freezing compartment expansion valve 15 is not excluded, and a refrigerant circulation system from which the switching valve 13, the refrigerating compartment expansion valve 14, and the refrigerating compartment evaporator are removed is not also excluded.

Hereinafter, as an example, the description will be limited to the structure in which the heat sink and the freezing compartment evaporator 17 are connected in series.

In addition, it should be noted that a first storage compartment means a storage compartment that is capable of being controlled to a predetermined temperature by a first cooling device, a second storage compartment means a storage compartment that is capable of being controlled to a temperature lower than that of the first storage compartment by the second cooling device, and a third storage compartment is defined as a storage compartment that is capable of being controlled to a temperature lower than that of the storage compartment 2 by a third cooling device.

In addition, the first cooling device may be defined as a unit for cooling the first storage compartment including at least one of a first evaporator and a first thermoelectric element including a thermoelectric element. The first evaporator may include the refrigerating compartment evaporator 16.

In addition, the second cooling device may be defined as a unit for cooling the second storage compartment including at least one of a second evaporator and a second thermoelectric element. The second evaporator may include the freezing compartment evaporator 17.

In addition, the third cooling device may be defined as a unit for cooling the third storage compartment including at least one of a third evaporator and a third thermoelectric element.

In the present invention, as an example, the first storage compartment may be a refrigerating compartment that is controlled to a temperature of above zero by the first cooling device, the second storage compartment is a freezing compartment that is controlled to a temperature below zero by the second cooling device, and the third storage compartment is a deep freezing compartment that is maintained at a temperature of a cryogenic temperature or an ultrafrezing temperature, which will be described later, by the third cooling device.

In the present invention, a case in which all of the third to third storage compartments are controlled to a temperature below zero, a case in which all of the first to third storage compartments are controlled to a above zero temperature, and a case in which the first and second storage compartments are controlled to the above zero temperature, and the third storage compartment is controlled to the temperature below zero are not excluded.

Hereinafter, as an example, the description is limited to the case in which the first storage compartment is the refrigerating compartment, the second storage compartment is the freezing compartment, and the third storage compartment is the deep freezing compartment.

A condensing fan 121 is mounted adjacent to the condenser 12, a refrigerating compartment fan 161 is mounted adjacent to the refrigerating compartment evaporator 16, and a freezing compartment fan 171 is mounted adjacent to the freezing compartment evaporator 17.

A refrigerating compartment maintained at a refrigerating temperature by cold air generated by the refrigerating compartment evaporator 16, a freezing compartment maintained at a freezing temperature by cold air generated by the freezing compartment evaporator 16, and a deep freezing compartment 202 maintained at a cryogenic or ultrafrezing temperature by a thermoelectric module to be described later are formed inside the refrigerator provided with the refrigerant circulation system according to the embodiment of the present invention.

The refrigerating compartment and the freezing compartment may be disposed adjacent to each other in a vertical direction or horizontal direction and are partitioned from each other by a partition wall. In addition, the deep freezing compartment may be provided at one side of the inside of the freezing compartment. In order to block the heat exchange between the cold air of the deep freezing compartment and the cold air of the freezing compartment, the deep freezing compartment 202 may be partitioned from the freezing compartment by a deep freezing case 201 having the high thermal insulation performance.

In addition, the thermoelectric module includes a thermoelectric element 21 having one side through which heat is absorbed and the other side through which heat is released when power is supplied, a cold sink 22 mounted on the heat absorption surface of the thermoelectric element 21, a heat sink mounted on the heat generation surface of the thermoelectric element 21, and an insulator 23 that blocks heat exchange between the cold sink 22 and the heat sink.

Here, the deep freezing compartment evaporator 24 is in contact with the heat generation surface of the thermoelectric element 21 to function as a heat sink. That is, the heat transferred to the heat generation surface of the thermoelectric element 21 is heat-exchanged with the refrigerant flowing inside the deep freezing compartment evaporator 24. FIG. 2 is a perspective view of the refrigerator door according to an embodiment. The refrigerant flowing along the inside of the deep freezing compartment evaporator 24 and absorbing heat from the heat generation surface of the thermoelectric element 21 is introduced into the freezing compartment evaporator 17. Hereinafter, the deep freezing compartment evaporator 24 is defined as a heat sink.

In addition, a cooling fan may be provided in front of the cold sink 22, and the cooling fan may be defined as the deep freezing compartment fan 25 because the fan is disposed behind the inside of the deep freezing compartment.

The deep freezing compartment fan 25 may be a suction type centrifugal fan that suctions air in an axial direction and discharges the suctioned air in a radial direction, and specifically may include a turbo fan.

The cold sink 22 is disposed behind the inside of the deep freezing compartment 202 and configured to be exposed to the cold air of the deep freezing compartment 202. Thus, when the deep freezing compartment fan 25 is driven to forcibly circulate cold air in the deep freezing compartment 202, the cold sink 22 absorbs heat through heat-exchange with the cold air in the deep freezing compartment and then is transferred to the heat absorption surface of the thermoelectric element 21. Also, the heat transferred to the heat absorption surface is transferred to the heat generation surface of the thermoelectric element 21.

Also, FIG. 2 is a perspective view of the refrigerator door according to an embodiment. The heat sink functions to absorb the heat absorbed from the heat absorption surface of the thermoelectric element 21 and transferred to the heat generation surface of the thermoelectric element 21 again to release the heat to the outside of the thermoelectric module 20.

Figure 3:
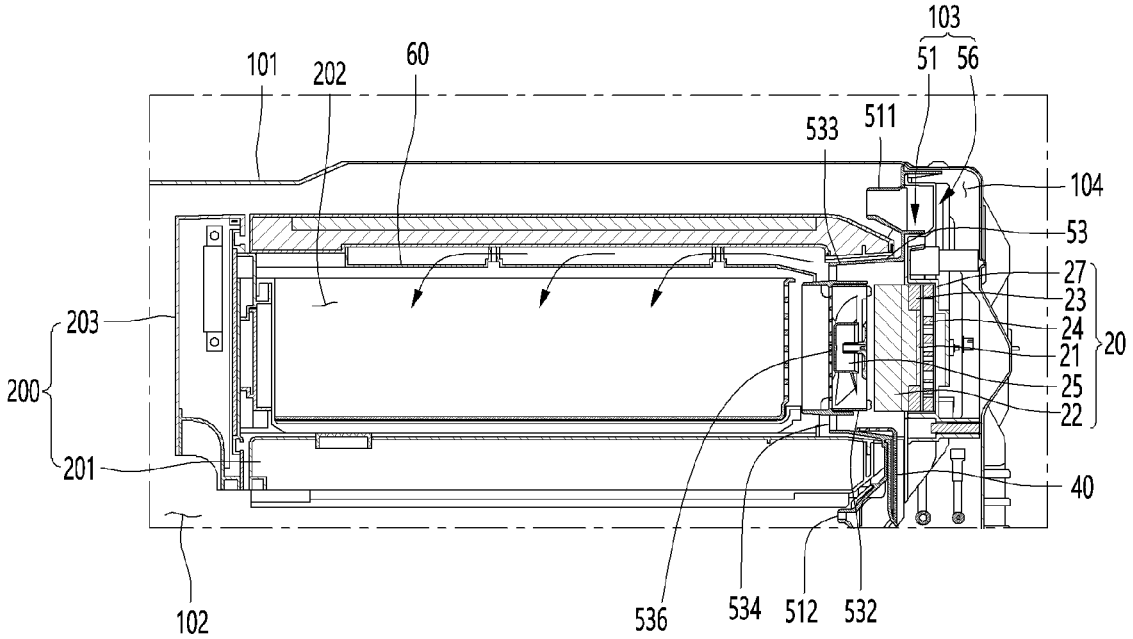
FIG. 3 is a longitudinal cross-sectional view taken along line 3-3 of FIG. 2.

FIG. 2 is a perspective view illustrating structures of the freezing compartment and the deep freezing compartment of the refrigerator according to an embodiment of the present invention, and FIG. 3 is a longitudinal cross-sectional view taken along line 3-3 of FIG. 2.

Referring to FIGS. 2 and 3, the refrigerator according to an embodiment of the present invention includes an inner case 101 defining the freezing compartment 102 and a deep freezing unit 200 mounted at one side of the inside of the freezing compartment 102.

In detail, the inside of the refrigerating compartment is maintained to a temperature of about 3° C., and the inside of the freezing compartment 102 is maintained to a temperature of about −18° C., whereas a temperature inside the deep freezing unit 200, i.e., an internal temperature of the deep freezing compartment 202 has to be maintained to about −50° C. Therefore, in order to maintain the internal temperature of the deep freezing compartment 202 at a cryogenic temperature of −50° C., an additional freezing means such as the thermoelectric module 20 is required in addition to the freezing compartment evaporator.

In more detail, the deep freezing unit 200 includes a deep freezing case 201 that forms a deep freezing compartment 202 therein, a deep freezing compartment drawer 203 slidably inserted into the deep freezing case 201, and a thermoelectric module 20 mounted on a rear surface of the deep freezing case 201.

In addition, the rear surface of the inner case 101 is stepped backward to form a freezing evaporation compartment 104 in which the freezing compartment evaporator 17 is accommodated. Also, an inner space of the inner case 101 is divided into the freezing evaporation compartment 104 and the freezing compartment 102 by the partition wall 103. Also, the thermoelectric module 20 is fixedly mounted on a front surface of the partition wall 103, and a portion of the thermoelectric module 20 passes through the deep freezing case 201 and is accommodated in the deep freezing compartment 202.

In detail, the heat sink 24 constituting the thermoelectric module 20 may be a deep freezing compartment evaporator connected to the freezing compartment expansion valve 15 as described above.

In addition, the thermoelectric module 20 may further include a housing 27 accommodating the heat sink 24. In addition, an insertion hole through which the housing 27 is inserted may be formed in the partition wall 103.

Since the two-phase refrigerant cooled to a temperature of about −18° C. to −30° C. while passing through the freezing compartment expansion valve 15 flows inside the heat sink 24, a surface temperature of the heat sink 24 may be maintained to a temperature of −18° C. to −30° C. Here, it is noted that a temperature and pressure of the refrigerant passing through the freezing compartment expansion valve 15 may vary depending on the freezing compartment temperature condition.

Also, when a rear surface of the thermoelectric element 21 is in contact with a front surface of the heat sink 24, and power is applied to the thermoelectric element 21, the rear surface of the thermoelectric element 21 becomes a heat generation surface.

Also, when the cold sink 22 is in contact with a front surface of the thermoelectric module, and power is applied to the thermoelectric element 21, the front surface of the thermoelectric element 21 becomes a heat absorption surface.

The cold sink 22 may include a heat conduction plate made of an aluminum material and a plurality of heat exchange fins extending from a front surface of the heat conduction plate. Here, the plurality of heat exchange fins extend vertically and are disposed to be spaced apart from each other in a horizontal direction.

Also, the deep freezing compartment fan 25 is disposed in front of the cold sink 22 to forcibly circulate air inside the deep freezing compartment 202.

In addition, the partition wall 103 may include a grille pan 51 exposed to cold air in the freezing compartment, and a shroud 56 attached to a rear surface of the grille pan 51.

In addition, the insertion hole into which the housing 27 is inserted may be formed in the grille pan 51 corresponding to a direct rear side of the thermoelectric module.

Freezing compartment-side discharge grilles 511 and 512 are disposed to protrude from a front surface of the grille pan 51 so as to be vertically spaced apart from each other, and a module sleeve 53 protrudes from the front surface of the grille pan 51 corresponding between the freezing compartment-side discharge grilles 511 and 512. A thermoelectric module accommodation space in which the thermoelectric module 20 is accommodated is formed in the module sleeve 53.

In more detail, a flow guide 532 may be provided in a cylindrical or polygonal cylindrical shape inside the module sleeve 53, and the inside of the flow guide 532 may be divided into a front space and a rear space by a fan grille part 536. A plurality of air through-holes may be formed in the fan grille part 536.

Also, deep freezing compartment-side discharge grilles 533 and 534 may be formed between the module sleeve 53 and the flow guide 532, i.e., an upper side and a lower side of the flow guide 532, respectively.

In addition, the deep freezing compartment fan 25 may be accommodated inside the flow guide 532 corresponding to the rear side of the fan grille part 536. In addition, a portion of the flow guide 532, which corresponds to a front space of the fan grille part 536 serves to guide a flow of cool air so that the cool air in the deep freezing compartment is suctioned into the deep freezing compartment fan 25. That is, the cold air introduced into the inner space of the flow guide 532 to pass through the fan grille part 536 is discharged in a radial direction of the deep freezing compartment fan 25 and is heat-exchanged with the cold sink 22. Then, the cold air that is cooled while being heat-exchanged with the cold sink 22 to flow in a vertical direction is discharged again to the deep freezing compartment through the deep freezing compartment-side discharge grills 533 and 534.

In addition, the thermoelectric module accommodation space may be defined as a space between a rear end of the flow guide 532 (or a rear end of the deep freezing compartment fan 25) and a rear surface of the grille pan 51.

Here, the housing 27 accommodating the heat sink 24 protrudes backward from a rear surface of the partition wall 103 and is placed in the freezing evaporation compartment 104. Thus, a rear surface of the housing 27 is exposed to the cold air of the freezing evaporation compartment 104, and thus, a surface temperature of the housing 27 is substantially maintained at the same or similar level to the temperature of the cold air in the freezing evaporation compartment.

The cold sink 22 may be accommodated in the thermoelectric module accommodation space, and the heat insulator 23, the thermoelectric element 21 and the heat sink 24 are accommodated in the housing 27.

In addition, a drain heater 40 is mounted on a bottom portion of the thermoelectric module accommodation space to melt ice separated from the cold sink 22 during a defrost operation (deep freezing compartment defrost) of the thermoelectric module and then converted into defrost water.

The deep freezing compartment-side discharge grills 533 and 534 may include an upper discharge grille 533 and a lower discharge grille 534. In addition, a guide duct 60 may be mounted at an outlet end of the upper discharge grille 533, and a recess (described later) for accommodating the guide duct 60 is formed in the ceiling of the deep freezing case 201.

Then, the cold air inside the deep freezing compartment 202 is suctioned in an axial direction of the deep freezing compartment fan 25, heat-exchanged with the cold sink 22, and then is discharged through the deep freezing compartment-side discharge grills 533 and 534. Particularly, the cold air discharged through the upper discharge grille 533 is guided along the guide duct 60 to a front region of the deep freezing compartment 202.

A front end of the guide duct 60 may be installed to be spaced a predetermined distance backward from the front end of the deep freezing case 201.

The structure of the guide duct 60 and the ceiling portion of the deep freezing case 201 will be described in more detail with reference to the drawings below.

Figure 4:
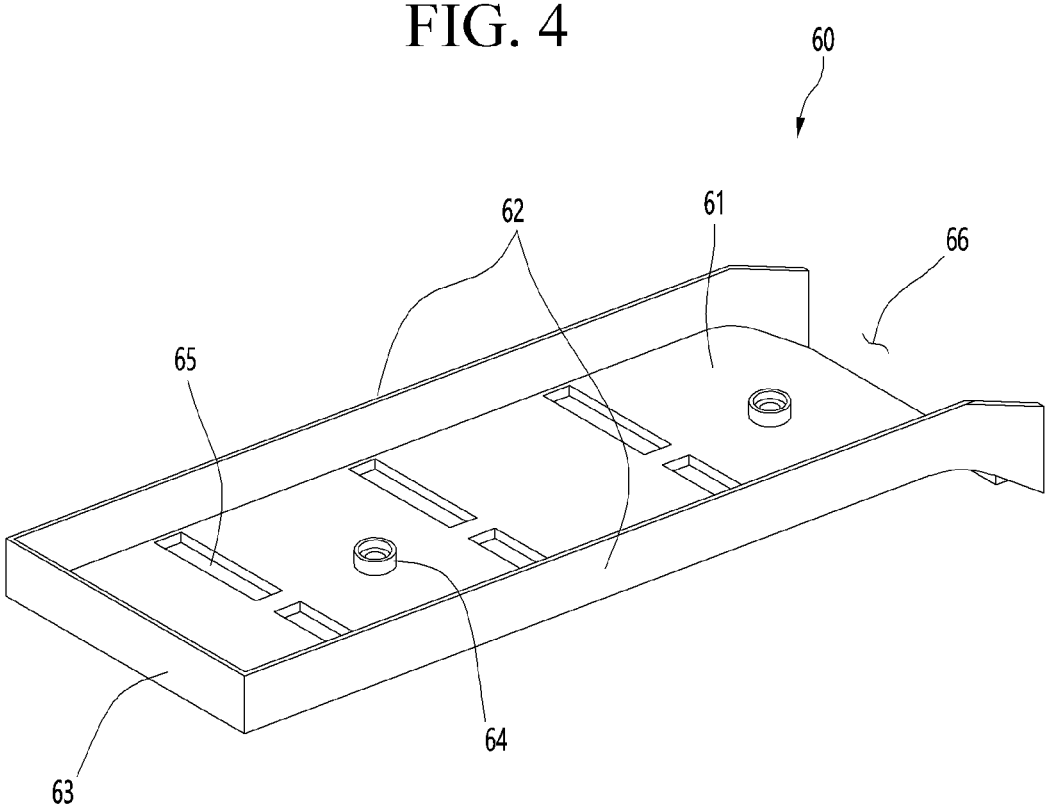
FIG. 4 is a perspective view of a guide duct mounted inside the deep freezing compartment according to an embodiment of the present invention.

FIG. 4 is a perspective view of the guide duct mounted inside the deep freezing compartment according to an embodiment of the present invention.

Referring to FIG. 4, the guide duct 60 according to an embodiment of the present invention is mounted on the ceiling of the deep freezing case 201 to communicate with a discharge end of the upper discharge grille 533.

In detail, the guide duct 60 may include a bottom portion 61 in which a plurality of cold air discharge holes 65 are formed, a front surface portion 63 extending upward from a front end of the bottom portion 61, and a side surface portion 62 extending upward both side ends of the bottom portion 61.

The front surface portion and the side surface portion are provided in the form of a single rib and are surrounded along an edge of the bottom portion 61. The front surface portion and the side surface portion may be defined as edge walls.

In addition, the rear surface portion of the guide duct 60 is opened to form a cold air inflow hole 66, and a top surface portion of the guide duct 60 is opened and shielded by the ceiling of the deep freezing case 201.

In addition, one or a plurality of coupling bosses 64 may protrude from the bottom portion 61. For example, the coupling boss may protrude from a point that is close to a central rear end and a central front end of the bottom portion 61 and may also protrude from a center of the bottom portion 61.

Also, as illustrated in the drawings, the plurality of cold air discharge holes 65 may be provided in a plurality of rows in a longitudinal direction of the bottom portion 61 from the rear end to the front end of the bottom portion 61. In addition, for each row, two cold air discharge holes may be formed at left and right sides based on a line bisecting the bottom portion 61 in a width direction. However, a structure in which one cold air discharge hole is lengthily formed in the width direction of the bottom portion is not excluded, and also, a structure in which three of more cold air discharge holes are arranged in each row in the width direction of the bottom portion 61 is not excluded.

In addition, the plurality of cold air discharge holes 65 may be formed in such a manner in which an area thereof gradually increases from the rear end to the front end of the guide duct 60.

This is because, as it goes away from the deep freezing compartment fan 25 toward the front end of the guide duct 60, a wind pressure decreases, and thus, an amount of cold air discharged from the cold air discharge hole that is close to the rear end of the guide duct 60 and an amount of cold air discharged from the cold air discharge hole that is close to the front end of the guide duct 60 are not uniform.

In order to minimize this phenomenon, a size or area of the cold air discharge hole formed at a point that is close to the rear end of the guide duct 60, that is, close to the deep freezing compartment fan 25 may be less than that of the cold air discharge hole formed at a point that is away from the deep freezing compartment fan 25.

Alternatively, it is also possible to arrange a distance between the cold air discharge holes that is adjacent in the longitudinal direction of the guide duct 60 to be narrower in a direction that is away from the rear end of the guide duct 60.

In addition, the rear end of the bottom portion 61 may be inclined downward or is formed to be rounded and thus may be coupled to be mounted on the upper end of the flow guide 532. Then, the discharge hole of the upper discharge grille 533 and the cold air inflow hole 66 of the guide duct 60 are in contact with each other to communicate with each other.

Figure 5:
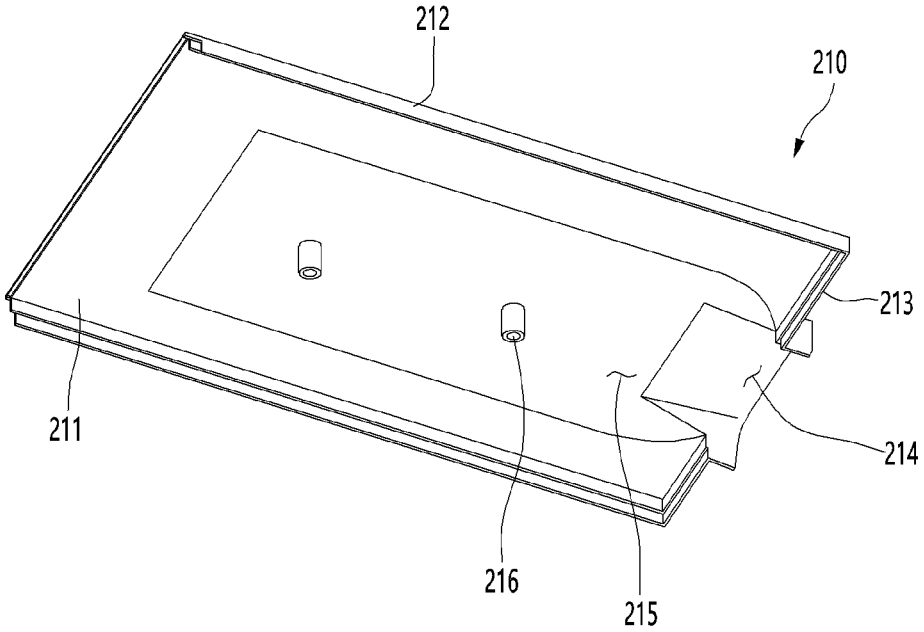
FIG. 5 is a bottom perspective view illustrating a case cover forming a ceiling of a deep freezing case according to an embodiment of the present invention.

FIG. 5 is a bottom perspective view illustrating a case cover forming the ceiling of the deep freezing case according to an embodiment of the present invention.

Referring to FIG. 5, the guide duct 60 is fixedly mounted to a case cover 210 forming the ceiling of the deep freezing case 201.

In detail, the case cover 210 includes a top surface portion 211, a side surface portion 212 extending downward from each of both side ends of the top surface portion 211, and a rear surface portion 213 extending downward from a rear end of the top surface portion 211.

In addition, a cold air guide groove 214 may be formed to be depressed upward in a center of the rear surface portion 213, and a duct coupling groove 215 in which the guide duct 60 is mounted is recessed or stepped in the top surface portion 211.

In addition, the cold air guide groove 214 may be formed to extend by a predetermined length to the inside of the duct coupling groove 215.

In addition, a width of the cold air guide groove 214 is formed to be the same as that of the upper discharge grille 533 or is formed to be slightly larger than that of the upper discharge grille 533. Thus, the rear surface portion 213 may be designed to surround a top surface and side surface of the upper discharge grille 533.

The duct coupling groove 215 may have a width and length corresponding to the width and length of the top surface of the guide duct 60 and may be formed to be recessed or stepped to a depth corresponding to a height of the front surface portion 63 and the side surface portion 62 of the guide duct 60.

In addition, a plurality of coupling bosses 216 coupled to the coupling boss 64 of the guide duct 60 may be formed to protrude from the top surface of the case cover 210 corresponding to a center of the duct defect groove 215.

Thus, a coupling member such as a screw may be inserted into the coupling boss 216 of the case cover 210 after passing through the coupling boss 64 from a lower side of the outside of the guide duct 60.

In this manner, the duct coupling groove 215 is formed in the case cover 2110, and the guide duct 60 is coupled to the duct coupling groove 215 to form an independent passage for supplying the cold air into the deep freezing compartment. In addition, since the independent passage does not undergo flow resistance due to food stored in the deep freezing compartment, there is an advantage in that the inside of the deep freezing compartment is uniformly cooled.

Figure 6:
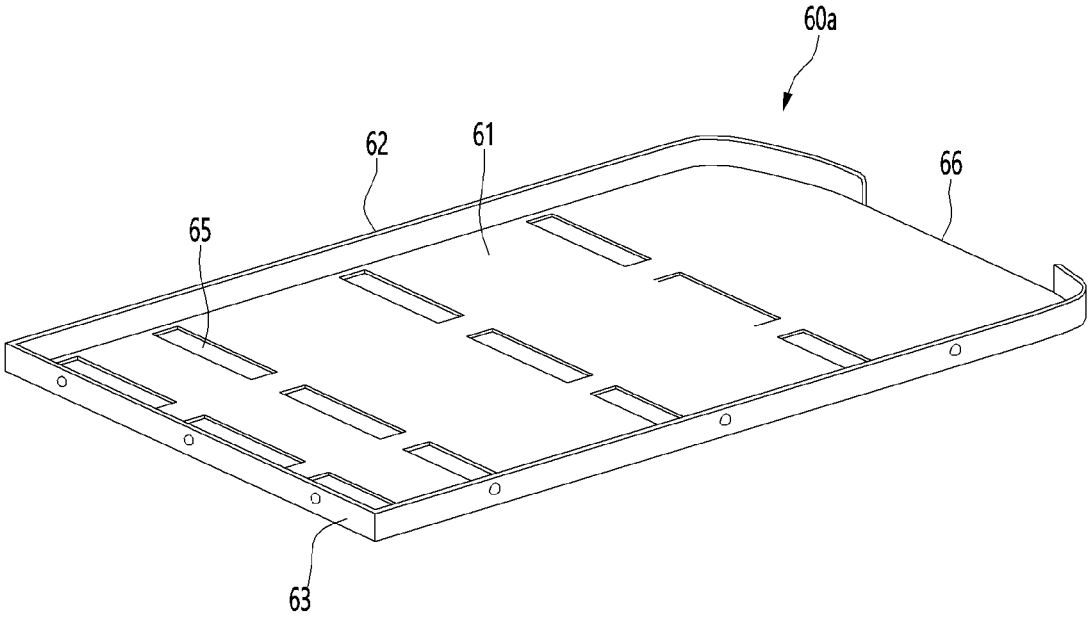
FIG. 6 is a perspective view of a guide duct according to another embodiment.

FIG. 6 is a perspective view of a guide duct according to another embodiment.

Referring to FIG. 6, a guide duct 60*a* according to this embodiment may be the same as the guide duct 60 disclosed in FIG. 4 except for a width of the guide duct and a coupling method with the case cover.

In detail, the guide duct 60*a* includes a bottom portion 61, a front surface portion 63, a side surface portion 62, and a rear surface portion 64, and a cold air inflow hole 66 is formed in the rear surface portion. The front surface portion 63, the side surface portion 62, and the rear surface portion 64 may be defined as an edge wall.

In addition, a plurality of cold air discharge holes 65 are formed in the bottom portion 61, and a method of forming the cold air discharge holes is the same as described with reference to FIG. 4.

A plurality of coupling protrusions 67 may protrude from an outer surface of the side surface portion 62 of the guide duct 60*a*, and the plurality of coupling protrusions 67 are spaced apart from each other in a longitudinal direction of the guide duct 60.

Figure 7:
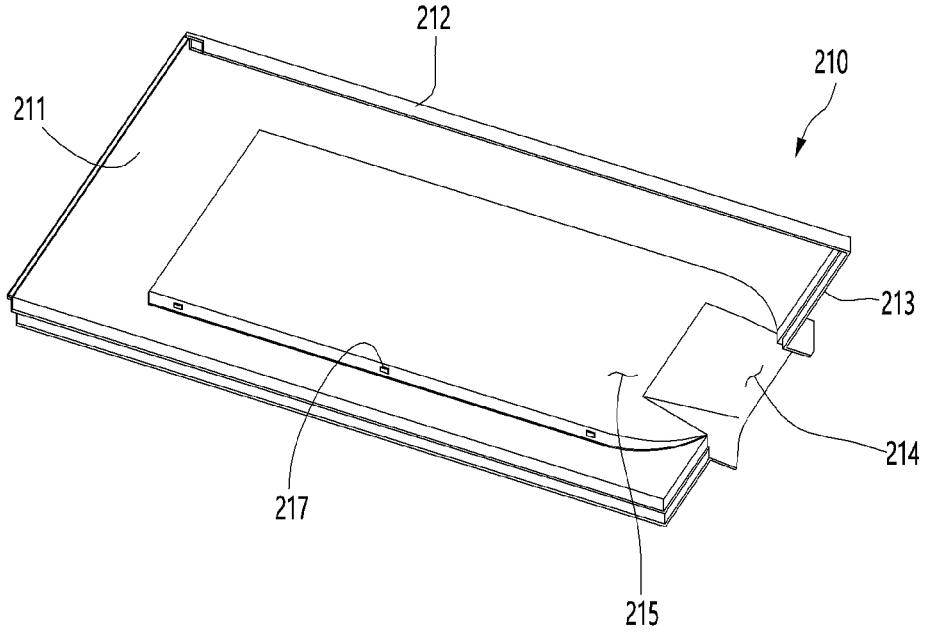
FIG. 7 is a bottom perspective view of a case cover according to another embodiment of the present invention.

FIG. 7 is a bottom perspective view of a case cover according to another embodiment of the present invention.

The guide duct 60*a* illustrated in FIG. 6 is coupled to the case cover 210*a*.

Referring to FIG. 7, the case cover 210*a* according to this embodiment has the same structure as the case cover 210 illustrated in FIG. 5, but is different in some parts.

Specifically, a width of a duct coupling groove 215 formed in a top surface portion 211 of the case cover 210*a* may be larger than a width of the duct coupling groove 215 illustrated in FIG. 5. This is because the width of the guide duct 60*a* illustrated in FIG. 6 is larger than the width of the guide duct 60 illustrated in FIG. 4.

In addition, a plurality of protrusion insertion holes 217 are formed in a side surface of the duct coupling groove 215, and the coupling protrusions 67 of the guide duct 60*a* are respectively inserted into the plurality of protrusion insertion holes 217.

A coupling protrusion may also protrude from a front surface portion 63 of the guide duct 60*a*, and the protrusion protruding from the front surface portion 63 is inserted into a portion of the deep freezing case. Particularly, a groove for inserting the protrusion protruding from the front surface portion 63 may be formed in a front end of a ceiling of the deep freezing case 201 to which the case cover 210*a* is coupled.

The invention claimed is:

1. A refrigerator comprising:

a refrigerating compartment;

a freezing compartment partitioned from the refrigerating compartment;

a freezing unit mounted at one side of an inside of the freezing compartment, the freezing unit comprising a cooling case defining a cooling compartment partitioned from the freezing compartment and a cooling drawer insertable into the cooling compartment;

a freezing evaporation compartment disposed behind the cooling case;

a partition wall to partition the freezing evaporation compartment and the freezing compartment from each other, the partition wall comprising a first discharge grille to discharge cold air into the cooling compartment and a second discharge grille to discharge another cold air into the freezing compartment;

a freezing compartment evaporator accommodated in the freezing evaporation compartment to generate the another cold air for cooling the freezing compartment;

a freezing compartment fan to supply the another cold air in the freezing evaporation compartment to the freezing compartment;

a thermoelectric module comprising:

a thermoelectric element having a heat absorption surface facing the cooling compartment and a heat generation surface that is an opposite surface of the heat absorption surface;

a cold sink in communication with the heat absorption surface and disposed behind the cooling compartment; and a heat sink in communication with the heat generation surface and functions as a cooling evaporator, the heat sink fluidly connected in series to the freezing compartment evaporator, the thermoelectric module configured to cool the cooling compartment to a temperature lower than that of the freezing compartment;

a cooling compartment fan to cause air within the cooling compartment to forcibly flow; and a guide duct mounted on a ceiling of the cooling case and communicating with the first grille, wherein the cooling compartment fan comprises a suction type centrifugal fan to suction the cold air of the cooling compartment in an axial direction of the centrifugal fan toward the thermoelectric module and discharge the suctioned cold air through the first discharge grille that is disposed above the thermoelectric module to the guide duct, wherein the cooling case comprises a case cover including a top portion to define the ceiling of the cooling case, wherein the guide duct comprises a bottom portion having a plurality of cold air discharge holes, wherein at least a portion of the bottom portion is spaced apart from the top portion at a lower side of the top portion to define a passage for guiding the cold air into the cooling compartment, wherein the case cover comprises a duct coupling groove to mount the guide duct therein.

2. The refrigerator according to claim 1, wherein the first discharge grille comprises:

an upper discharge grille at an upper side of a rear surface of the cooling compartment; and a lower discharge grille at a lower side of the rear surface of the cooling compartment, wherein the guide duct communicates with the upper discharge grille.

3. The refrigerator according to claim 2, wherein the guide duct comprises:

an edge wall extending upward along an edge of the bottom portion; and a cold air inflow hole defined at a rear surface portion of the guide duct, wherein the cold air inflow hole is in communication with the upper discharge grille.

4. The refrigerator according to claim 1, wherein the plurality of cold air discharge holes establish a plurality of rows in a direction from a rear end to a front end of the bottom portion, and a cold air discharge hole defined in each row is provided in one or more in a width direction of the bottom portion.

5. The refrigerator according to claim 1, wherein the plurality of cold air discharge holes comprises a first hole, a second hole and a third hole arranged in the direction from the rear end to the front end of the bottom portion, the first hole is disposed closer to the first discharge grille than the third hole and the second hole is disposed between the first hole and the third hole, a distance between the third hole and the second hole is less than a distance between the second hole and the first hole.

6. The refrigerator according to claim 1, wherein the guide duct further comprises one or more of coupling bosses protruding from the bottom portion, and the case cover comprises one or more of coupling bosses protruding from the duct coupling groove to be connected to the corresponding one or more of coupling bosses of the guide duct.

7. The refrigerator according to claim 1, wherein the guide duct comprises an edge wall extending upward along an edge of the bottom portion, a plurality of protrusions disposed along an outer surface of the edge wall, and the case cover comprises protrusion insertion holes which are disposed along a side surface portion of the duct coupling groove and into which the plurality of protrusions are inserted.

8. The refrigerator according to claim 1, wherein a front end of the guide duct is spaced a predetermined distance backward from a front end of the cooling case.

9. The refrigerator according to claim 1, wherein the thermoelectric module comprises a housing to accommodate the heat sink that protrudes backward from a rear surface of the partition wall and is placed in the freezing evaporation compartment.

10. A refrigerator comprising:

a refrigerating compartment;

a freezing compartment partitioned from the refrigerating compartment;

a freezing unit mounted at one side of an inside of the freezing compartment, the freezing unit comprising a cooling case defining a cooling compartment partitioned from the freezing compartment and a cooling drawer insertable into the cooling compartment;

a freezing evaporation compartment disposed behind the cooling case;

a partition wall to partition the freezing evaporation compartment and the freezing compartment from each other, the partition wall comprising a first discharge grille to discharge cold air into the cooling compartment and a second discharge grille to discharge another cold air into the freezing compartment;

a freezing compartment evaporator accommodated in the freezing evaporation compartment to generate the another cold air for cooling the freezing compartment;

a freezing compartment fan to supply the another cold air in the freezing evaporation compartment to the freezing compartment;

a thermoelectric module comprising:

a thermoelectric element having a heat absorption surface facing the cooling compartment and a heat generation surface that is an opposite surface of the heat absorption surface;

a cold sink in communication with the heat absorption surface and disposed behind the cooling compartment; and a heat sink in communication with the heat generation surface, a cooling compartment fan to cause air within the cooling compartment to forcibly flow; and a guide duct mounted on a ceiling of the cooling case and communicating with the first grille, wherein the cooling case comprises a case cover including a top portion to define the ceiling of the cooling case, a duct coupling groove recessed upward from the top portion, wherein the guide duct comprises a plurality of cold air discharge holes, wherein at least a portion of the guide duct is received in the duct coupling groove at a lower side of the top portion such that a surface to define the duct coupling groove and the guide duct define a passage for guiding the cold air into the cooling compartment.

11. The refrigerator according to claim 10, wherein the guide duct comprises a bottom portion having the plurality of cold air discharge holes, and an edge wall extending upward along an edge of the bottom portion, wherein at least a portion of the edge wall is received in the duct coupling groove.

12. The refrigerator according to claim 11, wherein the guide duct comprises one or more of coupling bosses protruding from the bottom portion, and the case cover comprises one or more of coupling bosses protruding from the surface to define the duct coupling groove to be connected to the corresponding one or more of coupling bosses of the guide duct.

13. The refrigerator according to claim 10, wherein a portion of the guide duct is positioned lower than the top portion.

14. A refrigerator comprising:

a refrigerating compartment;

a freezing compartment partitioned from the refrigerating compartment;

a freezing unit mounted at one side of an inside of the freezing compartment, the freezing unit comprising a cooling case defining a cooling compartment partitioned from the freezing compartment and a cooling drawer insertable into the cooling compartment;

a freezing evaporation compartment disposed behind the cooling case;

a partition wall to partition the freezing evaporation compartment and the freezing compartment from each other, the partition wall comprising a first discharge grille to discharge cold air into the cooling compartment and a second discharge grille to discharge another cold air into the freezing compartment;

a freezing compartment evaporator accommodated in the freezing evaporation compartment to generate the another cold air for cooling the freezing compartment;

a freezing compartment fan to supply the another cold air in the freezing evaporation compartment to the freezing compartment;

a thermoelectric module comprising:

a thermoelectric element having a heat absorption surface facing the cooling compartment and a heat generation surface that is an opposite surface of the heat absorption surface;

a cold sink in communication with the heat absorption surface and disposed behind the cooling compartment; and a heat sink in communication with the heat generation surface, a cooling compartment fan to cause air within the cooling compartment to forcibly flow; and a guide duct disposed within the cooling compartment and mounted on a ceiling of the cooling case and communicating with the first grille, wherein the guide duct comprises a bottom portion having the plurality of cold air discharge holes, the plurality of cold air discharge holes comprises a first hole, a second hole and a third hole arranged in a first direction from a rear end to a front end of the bottom portion, the first hole is disposed closer to the first discharge grille than the third hole and the second hole is disposed between the first hole and the third hole, a distance between the third hole and the second hole the first direction is less than a distance between second hole and the first hole in the first direction, wherein the case cover includes a duct coupling groove recessed upward from the top portion of the case cover to receive the guide duct.

15. The refrigerator according to claim 14, wherein the cooling case comprises a case cover including a top portion to define the ceiling of the cooling case, wherein at least a portion of the bottom portion is spaced apart from the top portion at a lower side of the top portion such that the bottom portion and the top portion define a passage for guiding the cold air into the cooling compartment.

16. The refrigerator according to claim 14, wherein a portion of the guide duct is positioned lower than the top portion.

* * * * *